US005438160A

United States Patent [19]

Batty

[11] Patent Number: 5,438,160

[45] Date of Patent: Aug. 1, 1995

[54] SEALED, SHIELDED AND FILTERED HEADER RECEPTACLE

[75] Inventor: William Batty, Winston-Salem, N.C.

[73] Assignee: The Whitaker Corporation, Wilmington, Del.

[21] Appl. No.: 995,476

[22] Filed: Dec. 22, 1992

[51] Int. Cl.[6] ..... H01R 13/66

[52] U.S. Cl. ..... 174/52.1; 439/620; 174/35 C

[58] Field of Search ..... 174/35 C, 52.1; 439/101, 102, 103, 104, 105, 107, 620

[56] References Cited

U.S. PATENT DOCUMENTS

| | | | |
|---|---|---|---|
| 4,657,323 | 4/1987 | Erbe | 339/17 R |
| 5,181,864 | 1/1993 | Wakino | 439/620 |
| 5,213,522 | 5/1993 | Kojima | 439/620 |

*Primary Examiner*—Leo P. Picard
*Assistant Examiner*—Geoffrey Cumbus
*Attorney, Agent, or Firm*—Bruce J. Wolstoncroft

[57] ABSTRACT

A header receptacle (10) which is protected against moisture and both conducted and radiated electromagnetic interferences. A flange (12) has a cured in place first sealant (20) disposed on the back side (14) of the flange wherein the first sealant (20) covers an opening in the center portion (16) of the flange (12). A metal shield (21) covers the first sealant (20) and is in electrical contact with the flange (12) by a conducting adhesive (18) which also adheres the metal shield (21) to the flange (12). An electromagnetic filter (26) is mounted adjacent to the metal shield (21). A plurality of spaced-apart male terminals (25) pass through the filter (26), the metal shield (21) and the first sealant (20). Each male terminal (25) is joined to the filter (26) to prevent exit/-entry of electromagnetic interferences. A housing (30) is disposed on the center portion (16) on the front side (13) of the flange (12). The housing (30) contacts the first sealant (20) and forms a waterproof seal therebetween. The plurality of male terminals (25) extend forwardly into the housing (30). A second sealant (31) is bonded to the center portion (16) of the front side (13) of the flange (12). It is compressed between the peripheral edge (15) of the flange and the enclosure 11 further preventing passage of moisture. The header receptacle (10) is fastened to an enclosure (11).

10 Claims, 6 Drawing Sheets

SEALED, SHIELDED AND FILTERED HEADER RECEPTACLE

The present invention relates to a connector used with a header and more particularly to a sealed, shielded and filtered header receptacle.

BACKGROUND OF THE INVENTION

Electronic equipment is frequently assembled using a header receptacle. Problems with the connector assembly can arise due to the presence of moisture and conducted and radiated electromagnetic interferences. Electromagnetic interference filters have been designed for use with some headers to reduce this type of problem.

It is important that the electrical connections of the header be free of moisture which could disrupt the circuit and that no electromagnetic interference be introduced into the circuit to produce spurious signals.

SUMMARY OF THE INVENTION

The present invention provides a header receptacle which is protected against moisture and both conducted and radiated electromagnetic interferences.

In accordance with the teachings of the present invention, there is disclosed herein a header receptacle for mounting in an enclosure. The header receptacle is waterproof and suppresses conducted and radiated electromagnetic interferences. The header receptacle includes a die cast flange having a front side, a back side, a peripheral edge and a center portion. The peripheral edge has a plurality of spaced-apart openings formed therein. The center portion of the flange has an opening therein. An electrical conducting adhesive is disposed on the center portion on the back side of the flange. A first sealant is disposed on the center portion on the back side of the flange wherein the first sealant covers the opening in the center portion. A metal sealant shield is disposed over the first sealant, extending over the center portion and contacting the conductive adhesive, so as to adhere thereto and to make electrical contact with the flange. A plurality of spaced-apart male terminals are disposed through the metal sealant shield and through the first sealant on the back side of the flange. Each male terminal extends outwardly from the metal sealant shield. An electromagnetic interference filter is mounted adjacent to the metal sealant shield and makes electrical contact with both the metal shield and the individual male terminals. The plurality of male terminals extend through the filter. The filter is electrically connected to the metal sealant shield. Means are provided to join the respective male terminals to the electromagnetic filter to prevent the exit/entry of electromagnetic interference therethrough. A housing is disposed on the center portion on the front side of the flange wherein the opening in the center portion is covered. The housing contacts the first sealant on the back side of the flange and also contacts the front side of the center portion of the flange. A waterproof seal is formed between the housing and the first sealant. The plurality of male terminals extend forwardly into the housing. A second sealant is bonded to the front side of the center portion of the flange and is disposed between the housing and the enclosure. Fastening means are disposed through the perspective openings in the circumferential edge of the flange to secure the header receptacle to the enclosure These and other objects of the present invention will become apparent from a reading of the following specification, taken in conjunction with the enclosed drawings.

BRIEF DESCRIPTION OF THE DRAWINGS

FIG. 3 is an alternate embodiment of FIG. 2 wherein the filter is in a horizontal position with respect to the flange.

DETAILED DESCRIPTION OF THE PREFERRED EMBODIMENTS

Figure 1:
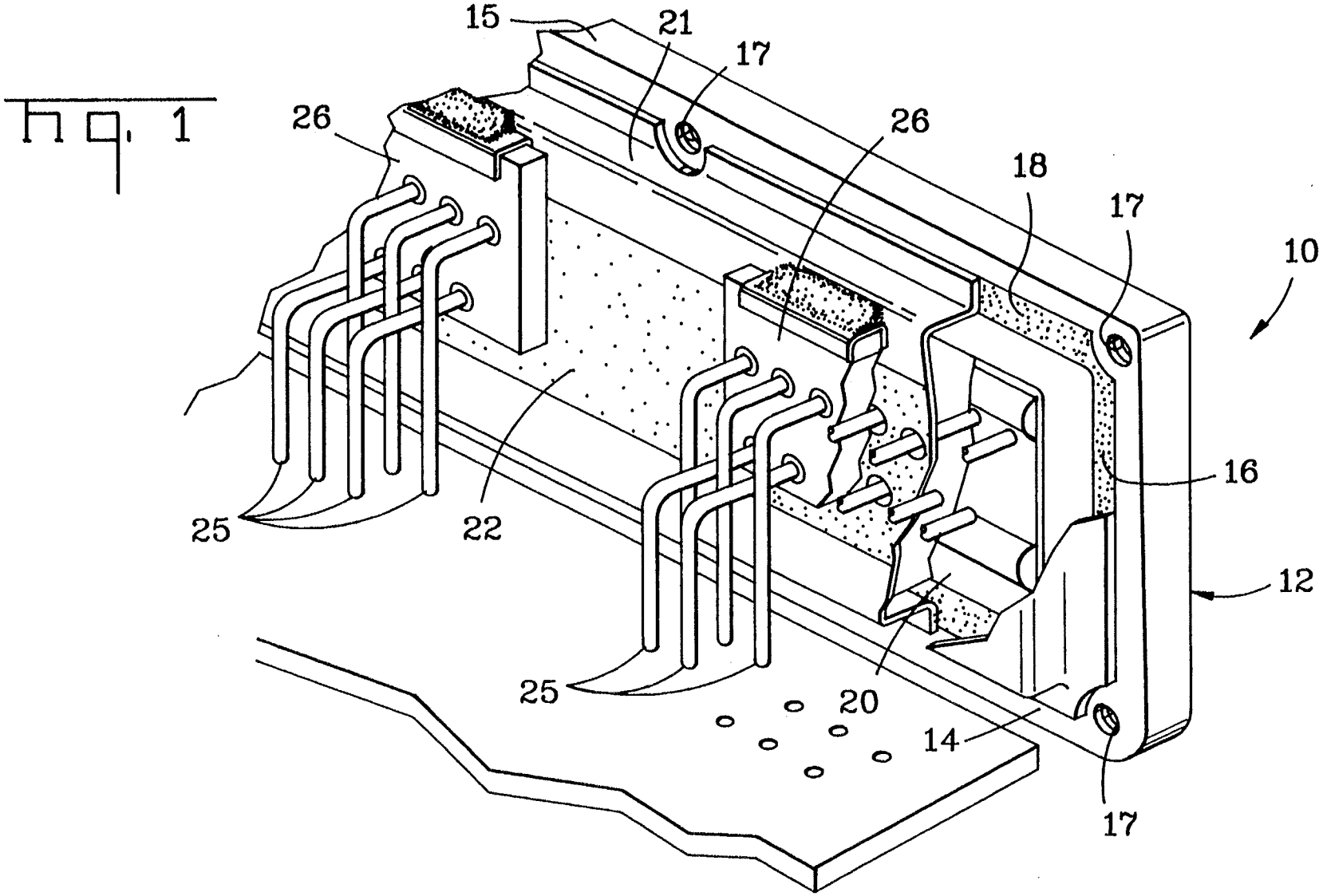
FIG. 1 is a partially cut-away perspective view of the back side of the header receptacle showing the flange, the conducting adhesive, the sealant, the sealant tray/-shield, the filter and the male terminals.

With reference to FIGS. 1–3 and 6, a header receptacle 10 is shown which can be mounted in an enclosure 11. The header receptacle 10 has a metal flange 12 which is preferably die cast. The flange 12 has a front side 13, a back side 14, a peripheral edge 15 and a center portion 16. A plurality of spaced-apart openings 17 are formed in the peripheral edge 15, the openings 17 extending from the front side 13 to the back side 14 of the flange 12. The center portion 16 of the flange 12 has a central opening therein. An electrically conducting adhesive 18 is disposed on the center portion 16 on the back side 14 of the flange 12.

A first sealant 20 is disposed on the back side 14 of the flange 12 such that the first sealant 20 completely covers the central opening in the center portion 16 of the flange 12. The first sealant 20, preferably, is of a type which is cured in place by exposure to ultraviolet radiation after being placed in the flange 12. A silicone sealant marketed by LocTite Corporation has been used satisfactorily as the first sealant.

A metal sealant shield 21 extends over the center portion 16 of the flange 12 and is formed as a tray having outer edges extending toward the front side of the flange 12 so that the outer edges of the metal shield 21 may contact and be adhered to the conducting adhesive 18. In this manner the metal tray/shield 21 is in electrical contact with the center portion 16 of the flange 12. The conducting adhesive is a useful means of obtaining electrical continuity since it is not easy to solder a die cast member. An electrical insulation coating 22 is disposed on both sides of the metal shield 21.

A plurality of spaced-apart male terminals 25 are disposed through the metal shield 21, through the insulation coatings 22 and through the sealant 20 on the back side 14 of the flange 12. Each male terminal 25 extends outwardly and rearwardly from the metal shield 21.

Figure 2:
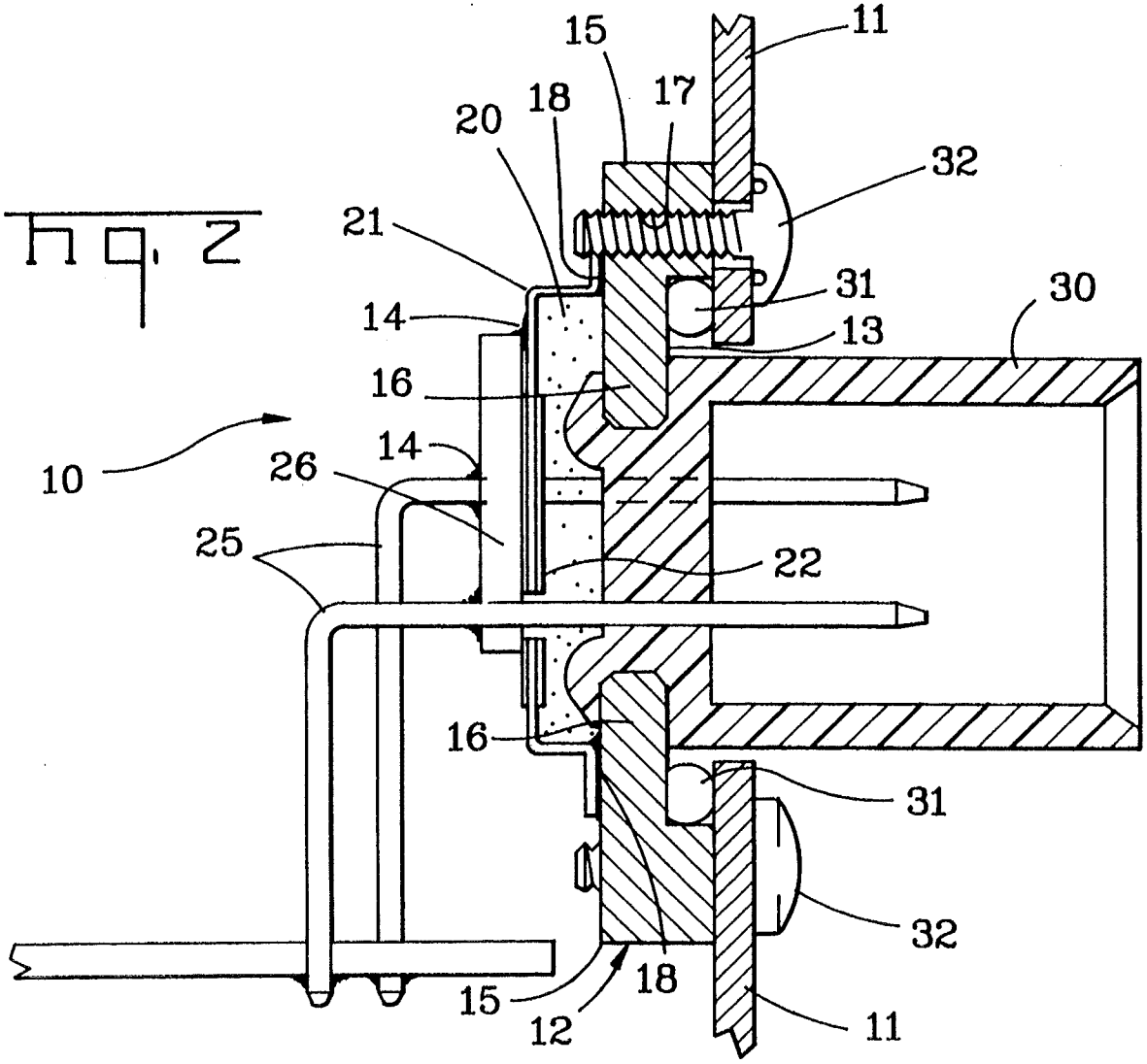
FIG. 2 is an enlarged cross-sectional view of the header receptacle assembled with the housing on the front side of the flange and connected to an enclosure wherein the filter is in a vertical position with respect to the flange.
Figure 7:
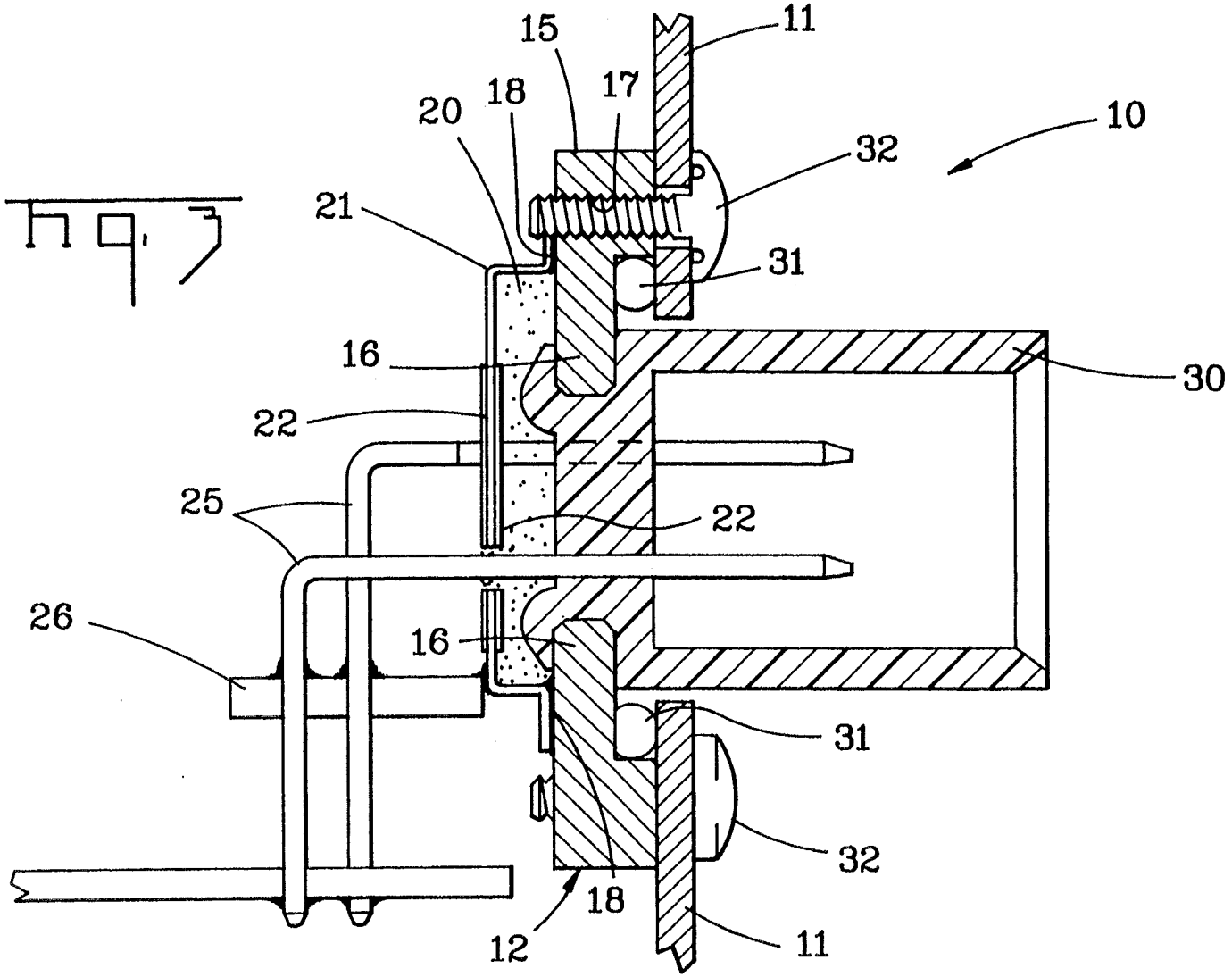

An electromagnetic interference filter 26 is mounted adjacent to and is electrically connected to the metal shield 21 by means of an electrical ground in the filter 26. The plurality of male terminals 25 extend through the filter 26 and the outer surface of each male terminal 25 is joined mechanically and electrically to the filter 26 by solder or other positive means to exclude either conducted or radiated electromagnetic interference. The filter 26 may be in a vertical position with respect to the flange 12 (FIG. 2) or in a horizontal position with respect to the flange 12 (FIG. 3). The configuration will depend upon the nature of the electronics of the circuit. For example, if a Pi circuit is used, with a portion of the circuit on the header and a portion on the connected printed circuit board, the horizontal arrangement may be necessary to provide processing access to the male terminal/filter solder junction. If plated or printed through holes are used, the filter would be installed vertically as shown in FIG. 2. This arrangement maximizes the effectiveness of the filter.

A housing 30, preferably of molded plastic, is disposed on the front side 13 of the flange 12. The housing 30 is in the form of a box having an open top. The bottom of the box covers the central opening in the center portion 16 of the flange 12 and is in contact with the sealant 20 on the back side 14 of the flange 12. The bottom of the housing 30 also contacts the center portion 16 on the front side 13 of the flange 12. The plurality of male terminals 25 extend forwardly of the flange 12 into the housing 30. In this manner, a moisture proof, water-proof closure is formed between the housing 30 in contact with the sealant 20 across the opening in the center portion 16 of the flange 12.

To further assure the moisture resistance of the header receptacle, a second sealant 31 is bonded to the front side 13 of the center portion 16 of the flange. The second sealant 31 extends completely around the interface between the front side 13 of the center portion 16 of the flange 12 and the enclosure 11. The second sealant 31 is preferably a foam-type material which is cured in place by exposure to ultraviolet radiation.

In order to mount the flange 12 on the enclosure 11, fastening means 32 are provided. The fastening means 32 may be a self sealing screw, a stud welded to the enclosure 11 or any other positive sealing means. Preferably a plurality of fastening means 32 are provided, each of which is received in a respective opening 17 formed in the peripheral edge 15 of the flange 12. Tightening of the fastening means 32 further serves to apply pressure to the second sealant 31 to ensure that moisture is prevented from passing through the header receptacle 10.

Figure 4:
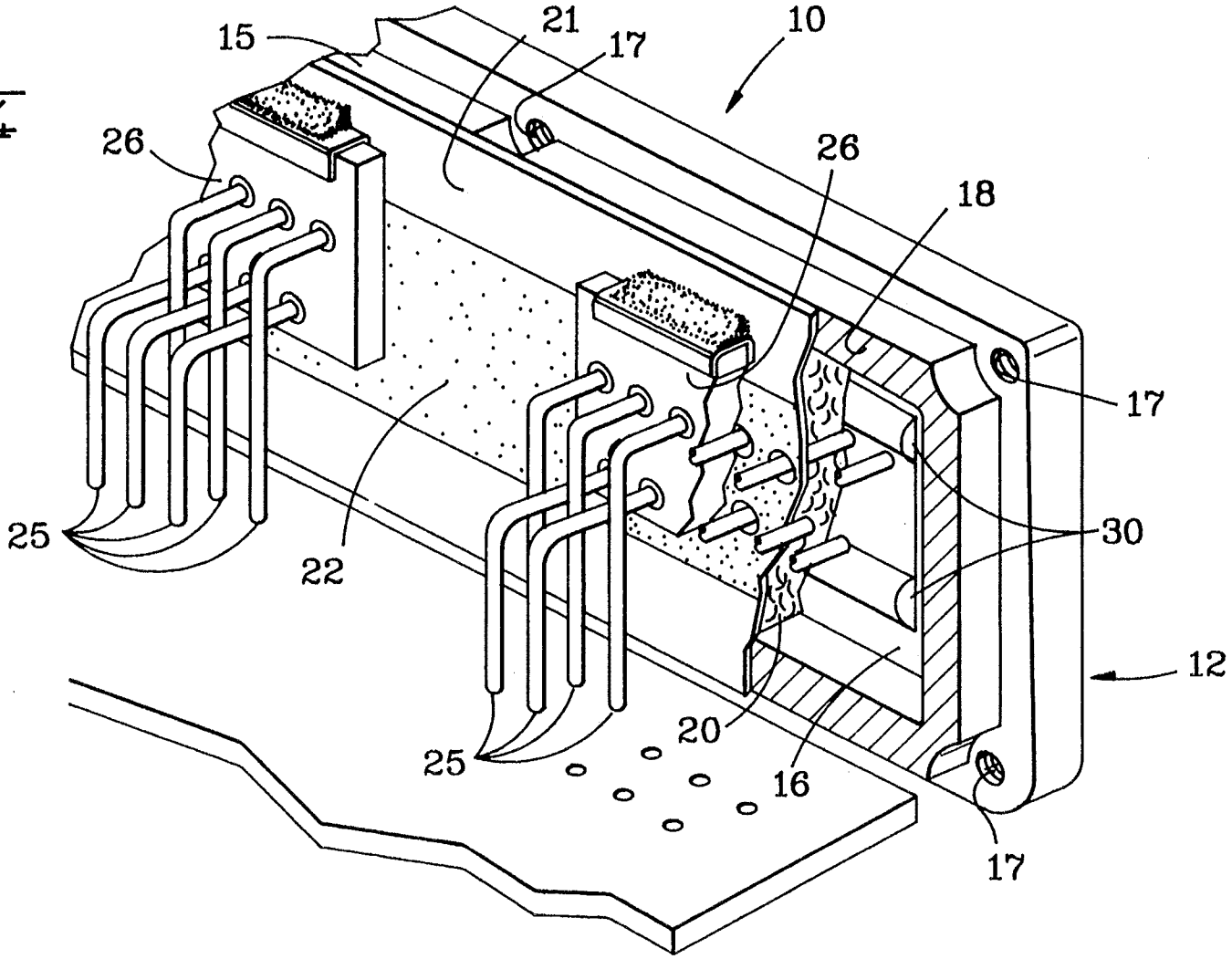
FIG. 4 is an alternate embodiment of FIG. 2 wherein the flange extends rearwardly and the metal sealant shield is flat.
Figure 5:
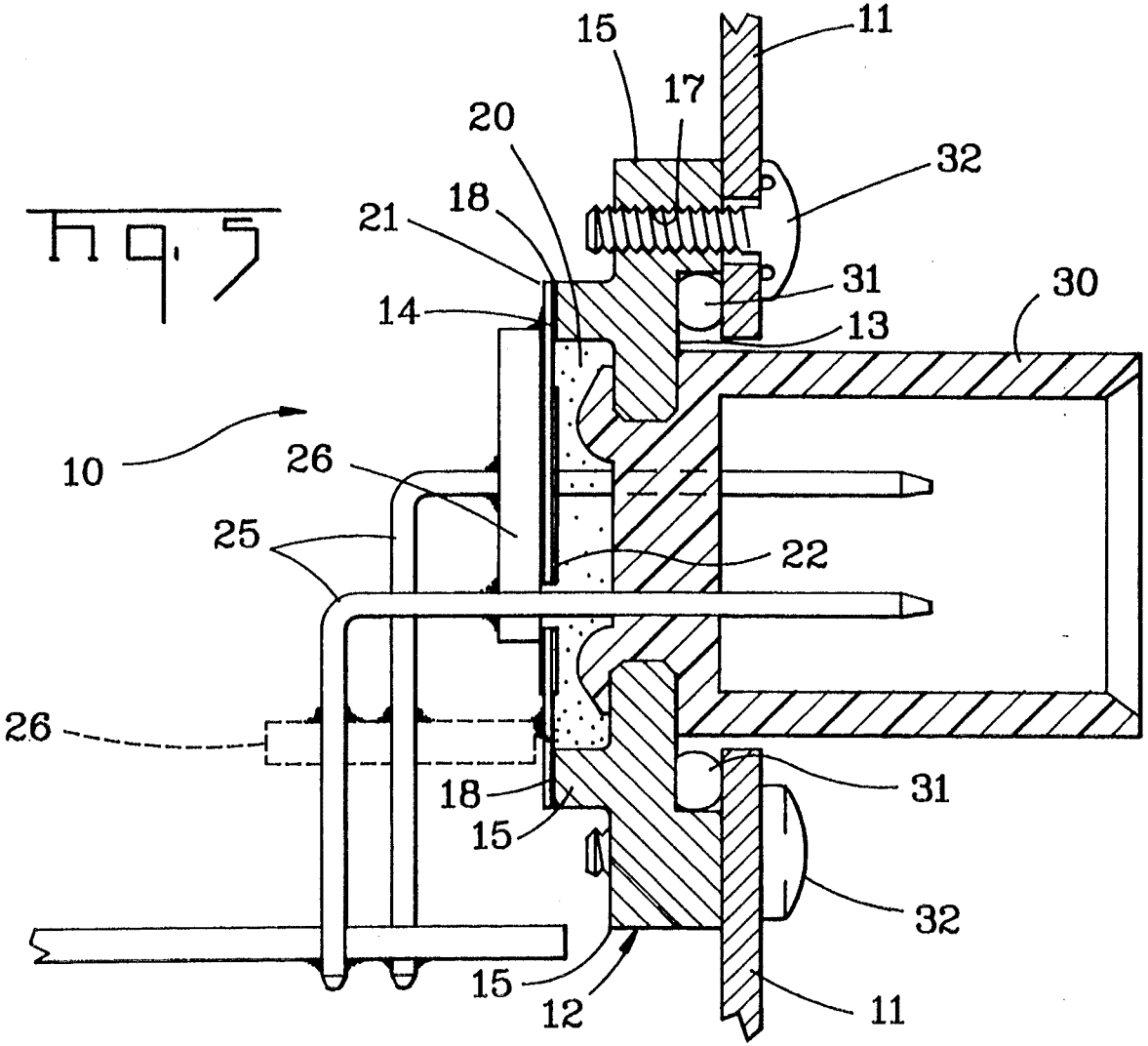
FIG. 5 is a cross-sectional view of the embodiment of FIG. 4.
Figure 6:
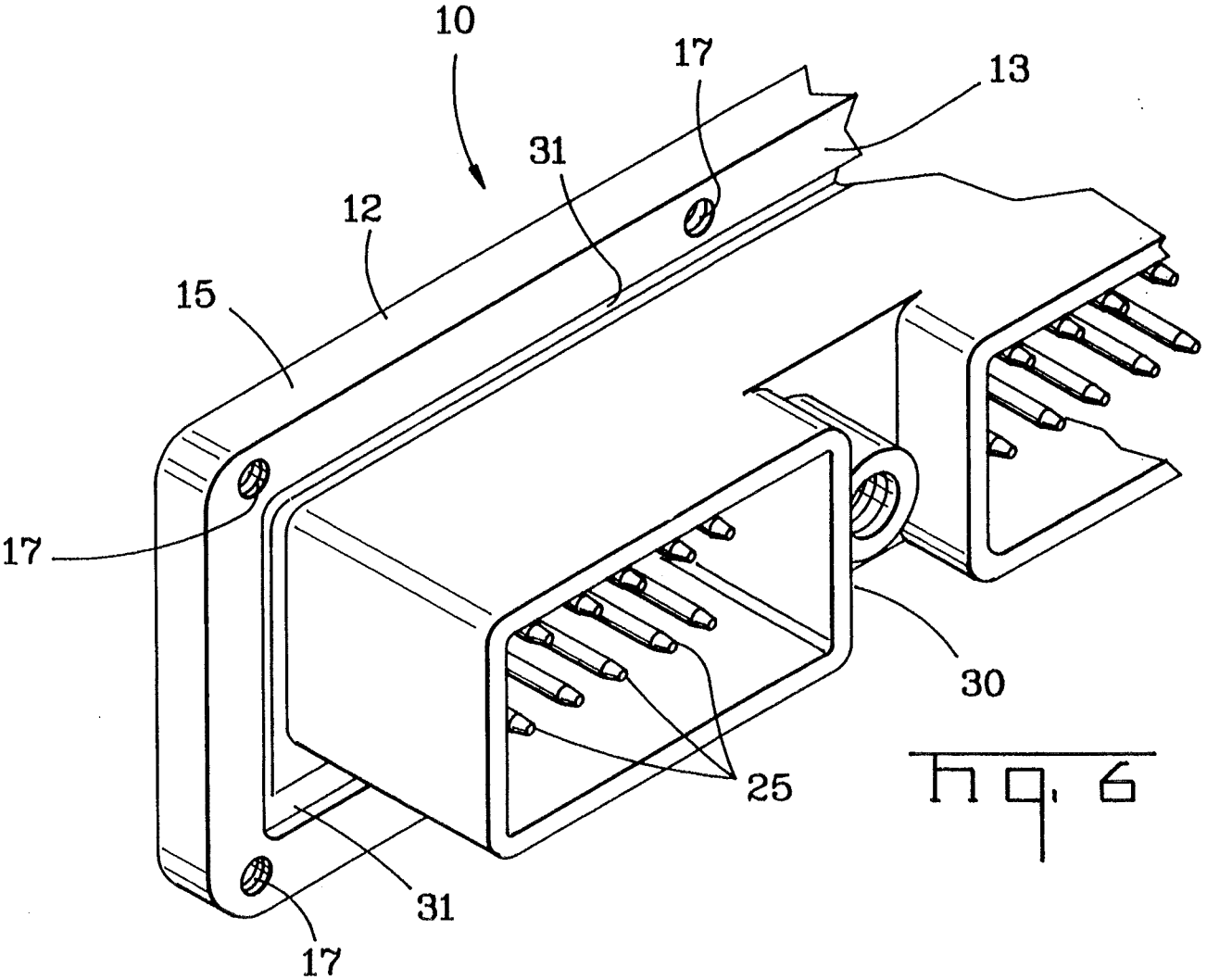
FIG. 6 is a perspective view of the front side of the header receptacle showing the housing mounted on the flange.

An alternate embodiment of the header receptacle 10 is shown in FIGS. 4 and 5. The back side of the peripheral edge 15 of the flange 12 is formed extending backwardly. The electrically conducting adhesive 18 is disposed on a portion of the back side of the peripheral edge 15. The first sealant 20 is disposed in the back side of the flange 12 so as to completely cover the central opening in the center portion 16 of the flange 12. After curing, the back side of the sealant 20 is substantially in the same plane as the back side of the peripheral edge 15 of the flange 12. The metal shield 21 which has insulation coating 22 on both sides thereof, is formed as a flat member having no outer edges extending toward the front side of the flange 12. The flat metal shield 21 contacts the conducting adhesive 18 and the back side of the peripheral edge 15 of the flange 12.

This alternate embodiment may have the electromagnetic interference filter 26 mounted in either a vertical position or in a horizontal position with respect to the flange 12. In FIG. 5, the horizontal position is shown in broken lines.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a header receptacle for mounting in an enclosure, the header receptacle being waterproof and suppressing conducted and radiated electromagnetic interferences, the improvement comprising:
   - a flange having a front side, a back side and a center portion, the center portion having a central opening therein;
   - an electrically conductive adhesive disposed on the back side of the flange;
   - a sealant disposed over the central opening of the center portion;
   - a metal shield disposed,over the sealant, said shield extending over the sealant and contacting the conductive adhesive so as to adhere thereto and to make electrical contact with the flange;
   - an electromagnetic interference filter mounted adjacent to the metal shield and electrically connected thereto;
   - a plurality of spaced-apart male terminals disposed through the filter, through the metal shield, through the sealant and extending forwardly of the flange;
   - means for joining the respective male terminals to the filter to prevent the exit/entry of electromagnetic interferences therethrough; and
   - a housing mounted on the front side of the flange, the housing being sealed against the sealant through the central opening in the center portion of the flange, the male terminals being disposed within the housing.

2. The header receptacle of claim 1 further comprising a second sealant bonded to the center portion on the front side of the flange and disposed between the flange and the enclosure.

3. The header receptacle of claim 2, wherein the sealant and the second sealant are cured in place.

4. The header receptacle of claim 1, wherein each male terminal has an outer surface, the outer surface of each male terminal being soldered to the electromagnetic filter.

5. The header receptacle of claim 1, further comprising the metal shield having a front side and a back side, an electrical insulation coating disposed on both sides of the metal shield, the plurality of male terminals extending through said insulation coatings.

6. A header receptacle for mounting in an enclosure, the header receptacle being waterproof and suppressing conducted and radiated electromagnetic interference, the header receptacle comprising:
   - a die cast flange having a front side, a back side, a peripheral edge and a center portion, the peripheral edge having a plurality of spaced-apart openings formed therein, the center portion having an opening therein;
   - an electrical conducting adhesive disposed on the back side of the flange;
   - a first sealant disposed on the center portion on the back side of the flange, wherein the first sealant covers the opening in the center portion;

a metal sealant shield disposed over the first sealant, said shield extending over the center portion and contacting the conducting adhesive so as to adhere thereto and to make electrical contact with the flange;

a plurality of spaced-apart male terminals disposed through the metal shield and through the first sealant on the back side of the flange, each male terminal extending outwardly from the metal shield;

an electromagnetic interference filter mounted adjacent to the metal shield and electrically connected thereto, the plurality of male terminals extending therethrough, said filter being electrically connected to each male terminal;

means for joining the respective male terminals to the electromagnetic filter to prevent the exit/entry of electromagnetic interference therethrough;

a housing disposed on the center portion on the front side of the flange, wherein the opening in the center portion of the flange is covered, the housing contacting the first sealant on the back side of the flange and forming a waterproof seal therebetween, the housing contacting the center portion on the front side of the flange, the plurality of male terminals extending forwardly into said housing;

a second sealant bonded to the center portion on the front side of the flange and disposed between the flange and the enclosure; and fastening means disposed through the respective openings in the peripheral edge of the flange to secure the header receptacle to the enclosure.

7. The header receptacle of claim 6, wherein the first sealant and the second sealant are cured in place.

8. The header receptacle of claim 6, wherein the fastening means are self sealing screws.

9. The header receptacle of claim 6, wherein each male terminal has an outer surface; the outer surface of each respective male terminal being soldered to the electromagnetic filter.

10. The header receptacle of claim 6, further comprising the metal shield having a front side and a back side, an electrical insulation coating disposed on both sides of the metal shield, the plurality of male terminals extending through said insulation coatings.

* * * * *